US009295904B2

(12) United States Patent
Vandoren

(10) Patent No.: US 9,295,904 B2
(45) Date of Patent: Mar. 29, 2016

(54) GAME PIECES

(75) Inventor: Rolf Vandoren, Kontich (BE)

(73) Assignee: Smart, Naamloze Vennootschap (BE)

( * ) Notice: Subject to any disclaimer, the term of this patent is extended or adjusted under 35 U.S.C. 154(b) by 0 days.

(21) Appl. No.: 14/003,133

(22) PCT Filed: Mar. 2, 2012

(86) PCT No.: PCT/BE2012/000011

§ 371 (c)(1),
(2), (4) Date: Sep. 4, 2013

(87) PCT Pub. No.: WO2012/119209

PCT Pub. Date: Sep. 13, 2012

(65) Prior Publication Data

US 2013/0341867 A1 Dec. 26, 2013

(30) Foreign Application Priority Data

Mar. 4, 2011 (BE) ..... 2011/0150

(51) Int. Cl.

| | |
|---|---|
| ***A63F 9/08*** | (2006.01) |
| ***A63H 33/04*** | (2006.01) |
| ***A63F 3/00*** | (2006.01) |
| ***A63H 33/06*** | (2006.01) |
| ***A63F 9/06*** | (2006.01) |
| *A63F 9/12* | (2006.01) |

(52) U.S. Cl.

CPC ..... *A63F 3/00697* (2013.01); *A63F 9/0669* (2013.01); *A63F 9/1288* (2013.01); *A63H 33/042* (2013.01); *A63H 33/062* (2013.01); *A63F 9/088* (2013.01); *A63F 2003/0081* (2013.01); *A63F 2003/00826* (2013.01); *A63F 2009/0698* (2013.01); *A63F 2009/1236* (2013.01); *A63F 2009/1244* (2013.01); *A63F 2009/1292* (2013.01)

(58) Field of Classification Search

CPC . A63F 3/00697; A63F 9/0669; A63F 9/1288; A63F 2009/0698; A63F 2003/0081; A63F 2003/00826; A63F 2009/1236; A63F 2009/1292; A63F 9/088; A63F 2009/1244; A63H 33/042; A63H 33/062

USPC ..... 273/153 S, 157 R, 156, 153 R; 446/85, 446/102, 104, 120, 124, 125

See application file for complete search history.

(56) References Cited

U.S. PATENT DOCUMENTS

| | | | | | |
|---|---|---|---|---|---|
| 2,825,178 | A | * | 3/1958 | Hawkins | 446/119 |
| 3,577,673 | A | * | 5/1971 | Monestier | 446/490 |
| 4,325,552 | A | * | 4/1982 | Glasheen | 273/157 R |
| 4,617,001 | A | * | 10/1986 | Parein | 446/120 |

(Continued)

FOREIGN PATENT DOCUMENTS

| | | | |
|---|---|---|---|
| EP | 1716894 | A1 | 11/2006 |
| GB | 2090751 | A | 7/1982 |

*Primary Examiner* — Steven Wong
(74) *Attorney, Agent, or Firm* — Bacon & Thomas, PLLC

(57) ABSTRACT

Game piece (1) comprising three or more sphere-shaped elements (6) which are connected to each other, wherein the elements (6) are divided into two or more groups (7, 8, 9) each consisting of at least one element (6), wherein the elements (6) within one group (7, 8, 9) are immovably connected to each other and wherein each group (7, 8, 9) is rotationally connected to at least one other group (7, 8, 9), and wherein there is at least one group (7, 8, 9) with two or more elements (6).

15 Claims, 7 Drawing Sheets

(56) References Cited

U.S. PATENT DOCUMENTS

| | | | | | |
|---|---|---|---|---|---|
| 4,699,602 | A * | 10/1987 | Giorgi | 446/124 |
| 4,988,103 | A * | 1/1991 | Cheng | 273/157 R |
| 4,997,375 | A * | 3/1991 | Heinz | 446/119 |
| 5,302,148 | A * | 4/1994 | Heinz | 446/119 |
| 5,503,497 | A | 4/1996 | Dudley et al. | |
| 5,897,417 | A * | 4/1999 | Grey | 446/125 |
| 6,220,919 | B1 * | 4/2001 | Cheng | 446/117 |
| 6,264,522 | B1 * | 7/2001 | Dickson | 446/120 |
| 7,354,330 | B2 * | 4/2008 | Bentley, Jr. | 446/102 |
| 8,020,867 | B2 * | 9/2011 | Cheng | 273/157 R |
| 8,480,449 | B2 * | 7/2013 | Cheng | 446/124 |
| 8,607,541 | B1 * | 12/2013 | Cavuoti | 446/120 |
| 2003/0186616 | A1 * | 10/2003 | Manville et al. | 446/85 |
| 2003/0224690 | A1 * | 12/2003 | Manville et al. | 446/113 |
| 2005/0197039 | A1 | 9/2005 | Bentley, Jr. | |
| 2007/0187890 | A1 * | 8/2007 | Cheng | 273/156 |
| 2013/0012098 | A1 * | 1/2013 | Meys | 446/85 |

* cited by examiner

GAME PIECES

The present invention relates to game pieces, a set of such game pieces, a game and the use of such game pieces.

More specifically the invention relates to game pieces in the form of connected sphere-shaped elements.

By connecting the elements to one another in different ways, for a given number of elements different figures can be obtained that can each form a game piece.

The game pieces are intended for use in puzzle-type games in which a two dimensional field or a three dimensional volume is to be filled completely or to a certain degree by consecutively placing game pieces and/or in strategy-type games in which one of a set of predefined winning placements needs to be made in a multi-player game wherein the placement of a game piece by a certain player influences the remaining options for the other players.

The purpose of the present invention is to create game pieces which, compared to the known game pieces, provide extra possibilities for devising all kinds of games.

To this end the invention concerns a game piece comprising three or more sphere-shaped elements which are connected to each other, wherein the elements are divided into two or more groups each consisting of at least one element, wherein the elements within one group are immovably connected to each other and wherein each group is rotationally connected to at least one other group and wherein there is at least one group with two or more elements This allows game pieces to be changed from one configuration to another configuration, thereby allowing different types of puzzles or game play.

It is possible that an element may be considered to belong to simultaneously to two groups, as will become clear later.

In a preferred embodiment, the sphere-shaped elements are placed at a centre-to-centre distance from each other which is the same as the diameter of the sphere defined by the sphere-shaped elements.

This allows three-dimensional volumes to be filled with the game pieces, wherein a game piece can extend from one layer in a game or puzzle to another layer, and wherein a layer may then be partly filled with elements from game pieces which are also in other layers, and partly filled with elements from game pieces which are only present in the specific layer.

In the absence of this feature, this would not be possible, as the distance between the layers would then not match the distance between the elements within a layer.

Obviously the filling of a two dimensional space, as well as the filling of a three-dimensional volume in a layer-by-layer fashion, so without any game pieces extending over two or more layers, remains equally possible.

In a further preferred embodiment, for each combination of adjacent rotationally connected groups an element of one of the two connected groups, which element borders the other connected group, is formed as a spherically shaped hinge, whereby this hinge has a physical axis at the position of the axis of rotation.

This allows games pieces which are sturdy and not easily damaged.

In a further preferred embodiment the hinge is provided with indicating means to indicate that the two groups connected by the hinge have one or more preferential rotational positions as defined by the angle formed between the line between the centre of the element which is formed as a hinge and the centre of the adjacent element in the same group, and the line between the centre of the element which is formed as a hinge and the centre of the adjacent element in the other group.

This way the user of the game piece knows when a game piece is in a configuration which is suitable for the game or puzzle it should be used in, and when it is in a configuration which is not or less suited for a particular game or puzzle.

In preferred embodiments, the hinge has preferential positions at values of the angle of 90° and 180° or at values of the angle of 60°, 120° or 180°.

With both these alternatives regular 2 and 3 dimensional patterns of sphere-shaped elements can be made, which makes these configurations particularly useful.

In a further preferred embodiment the indicating means work by providing a resistance to rotation which is larger when the two groups are in a preferred position than when the two groups are not in such a position and comprise at least one protrusion on one part of the hinge and at least one recess in another part of the hinge.

This is a practical way of implementing the feedback to the user.

In another preferred embodiment the hinge is provided with a stop to stop further rotational movement at a certain rotational position and is provided with means for avoiding damage if further force is applied if this position is reached, which means comprise a circular groove in one part of the hinge and a matching circular ridge on another part of the hinge, the groove and the ridge having a centre coinciding with the axis of rotation of the hinge.

Two groups of elements can be rotated, but a stop can be provided so that the groups may not be rotated more than a certain amount. However, there is a risk that due to excessive pressure, the game piece deforms and/or breaks.

In this preferred embodiment this damage can occur less easily, because the process leading to damage involves as a first step the displacement of the designed axes of rotation of two parts of a hinge, which are normally coinciding, with respect to each other.

Due to the ridge and groove this displacement is avoided, as they resist displacement, in a plane perpendicular to the axis of rotation, of one part of a hinge with respect to another part.

In a further preferred embodiment the hinge has a hinging axis which is visible or indicated.

This makes it easier to the user of the game piece to manipulate the game piece, since this way he always knows, when holding a game piece, at which points movement is possible.

The invention also concerns a set of game pieces consisting of a number of game pieces according to any of the previous claims.

The invention further concerns a game or puzzle that contains a set of game pieces as explained above, either or not in combination with a playing board with a multitude of recesses matching the spherical elements both in shape as well as in mutual distance.

The invention further concerns the use of a game piece as defined above in a puzzle in which several such game pieces are intended to fill a two dimensional field or a three dimensional volume and/or in a game in which the placement of a game piece in such a field or volume influences the options another player in the game has for placing a subsequent game piece.

With the intention of better showing the characteristics of the invention, a few preferred embodiments of game pieces according to the invention are described hereinafter by way of an example, without any limiting nature, with reference to the accompanying drawings, wherein.

Figure 1:
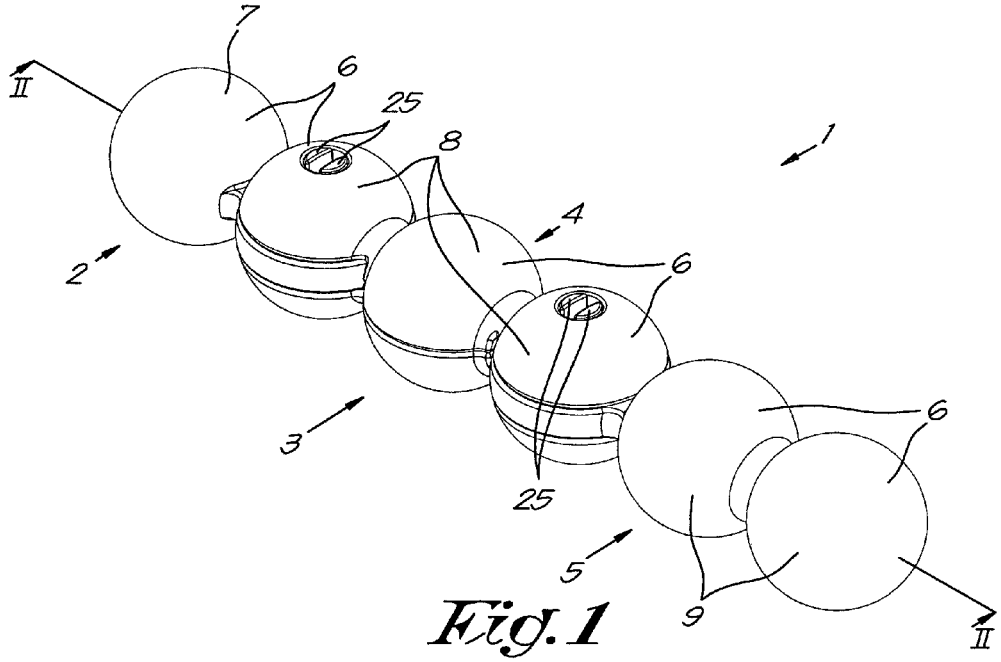
FIG. 1 shows a perspective view of a game piece according to the invention.
Figure 6:
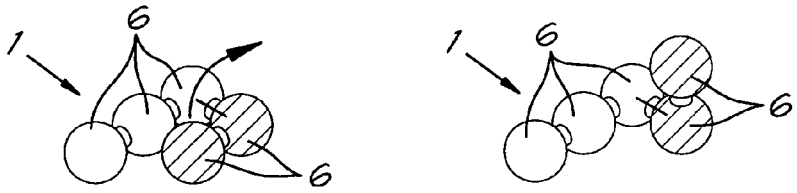
Figure 7:
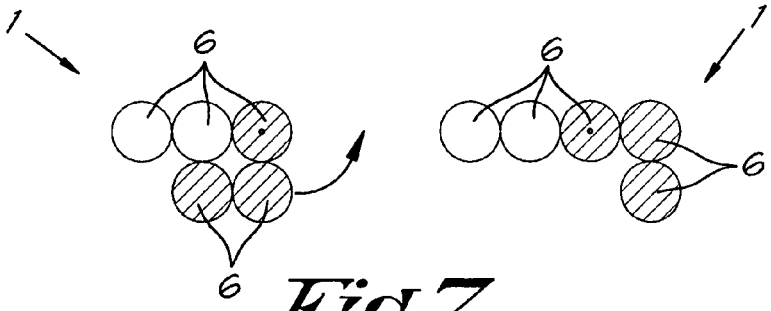
Figure 8:
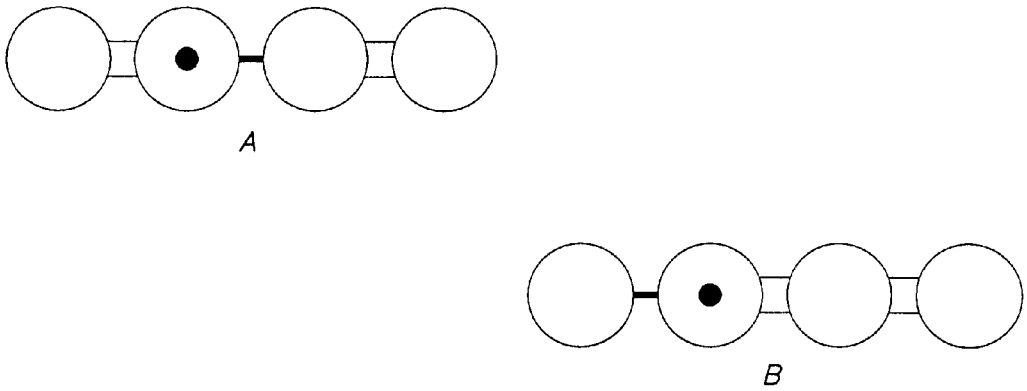
Figure 9:
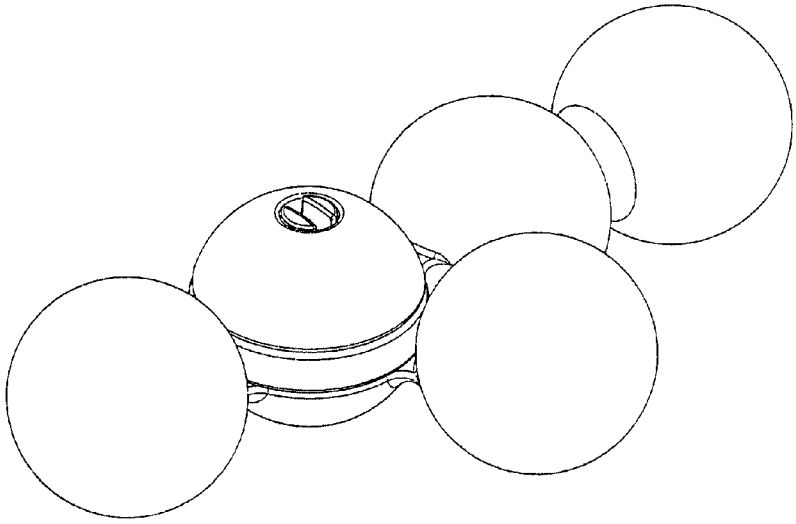
Figure 10:
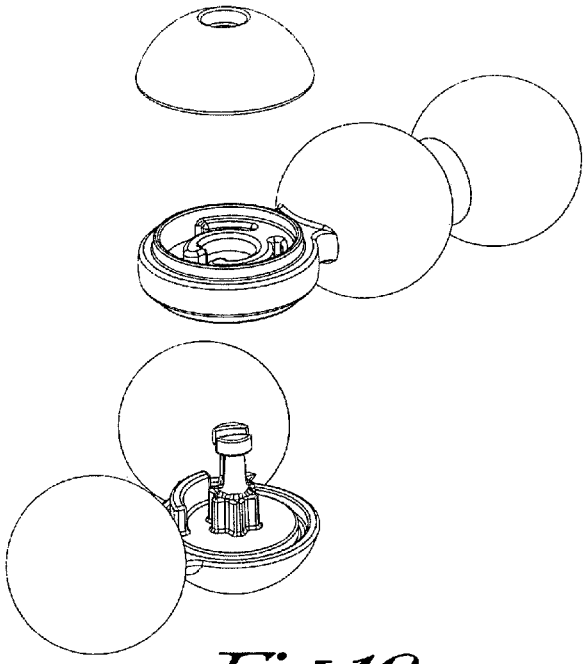
Figure 11:
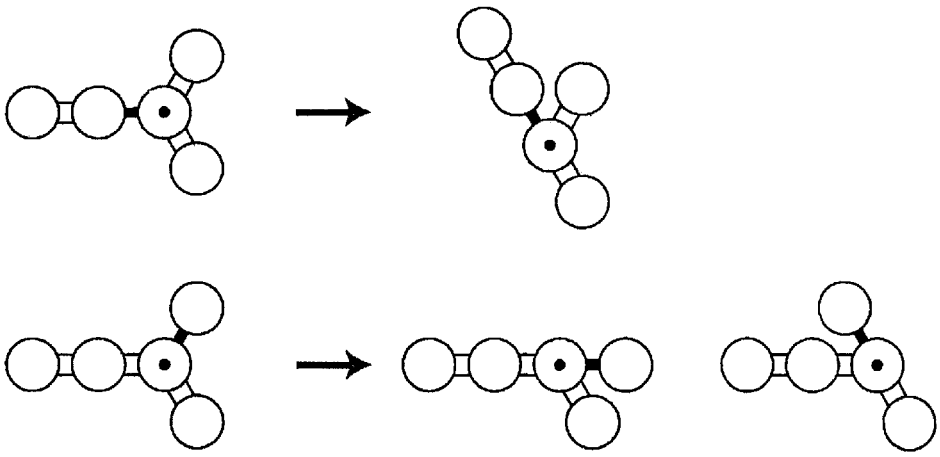
Figure 12:
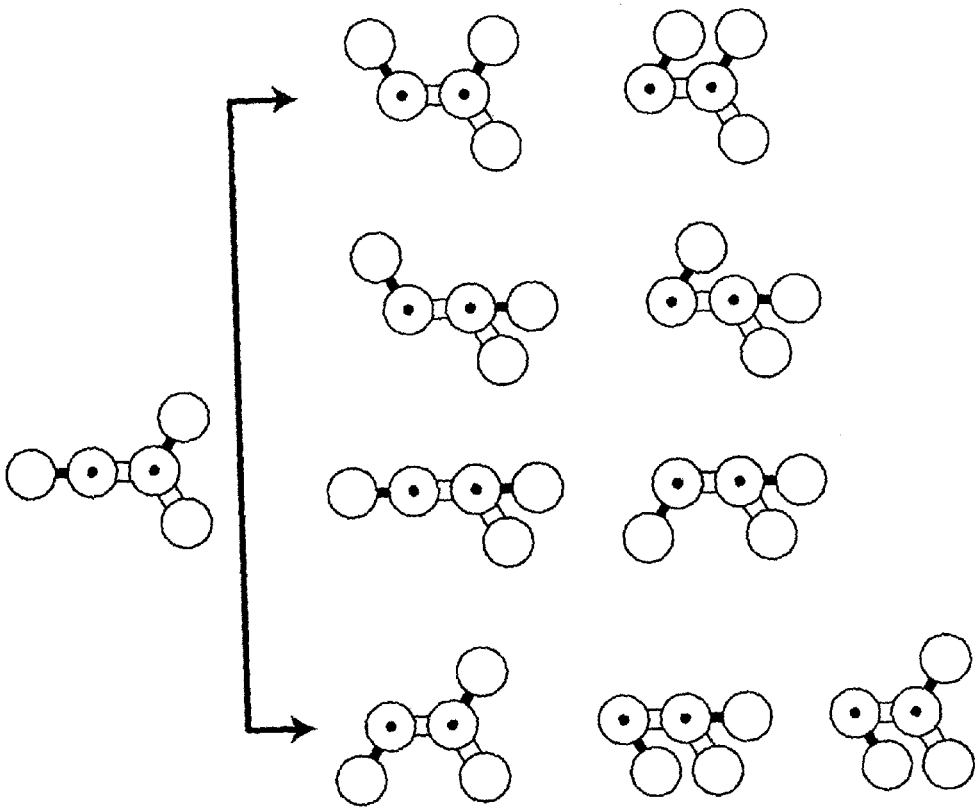
Figure 13:
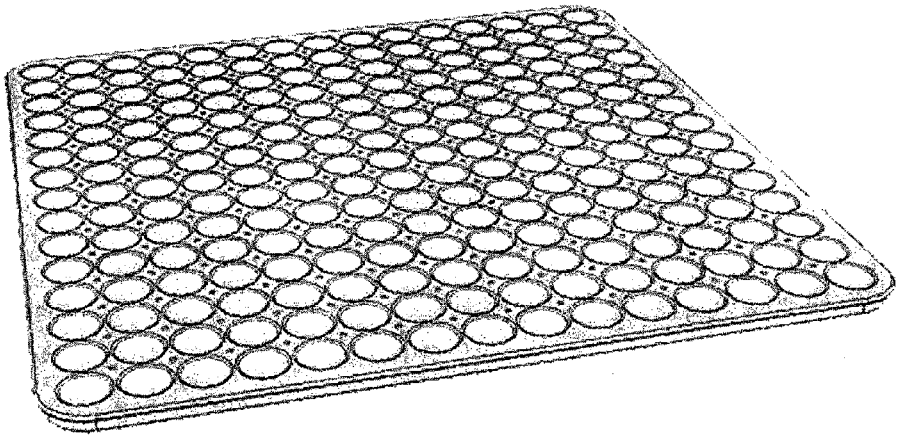
Figure 14:
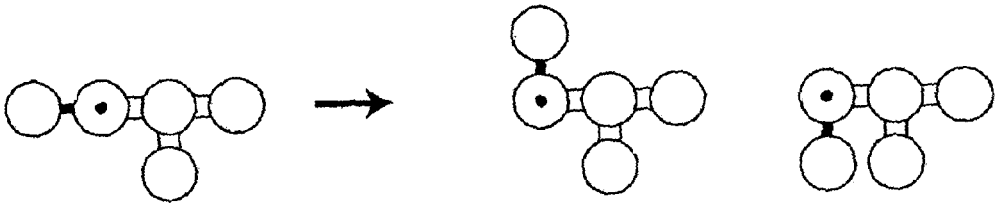
Figure 15:
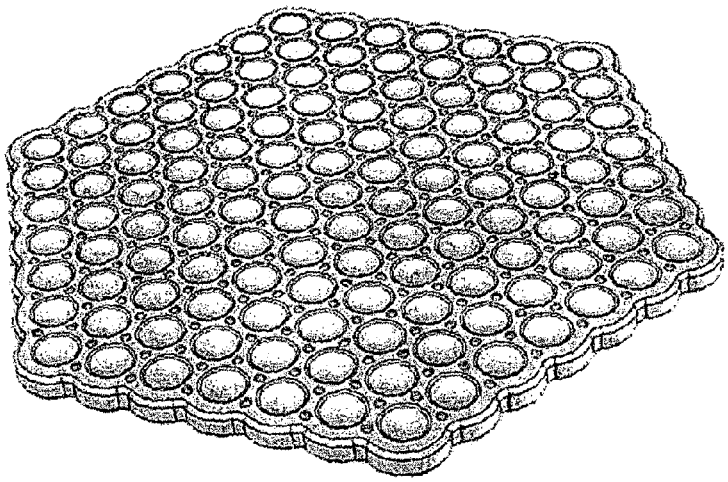

FIGS. 6 and 7 schematically show alternative game pieces according to the invention;

FIG. 8 schematically shows two versions of a game piece according to the invention;

FIGS. 9 and 10 show a further alternative game piece according to the invention in a perspective and exploded view;

FIGS. 11 and 12 show further alternative game pieces according to the invention, together with the possible configurations these game pieces may take;

FIG. 13 shows a game board to be used with game pieces according to FIG. 1;

FIG. 14 shows a further alternative game piece according to the invention; and FIG. 15 shows an alternative game board, to be used with game pieces according to FIGS. 9 and 10.

Figure 2:
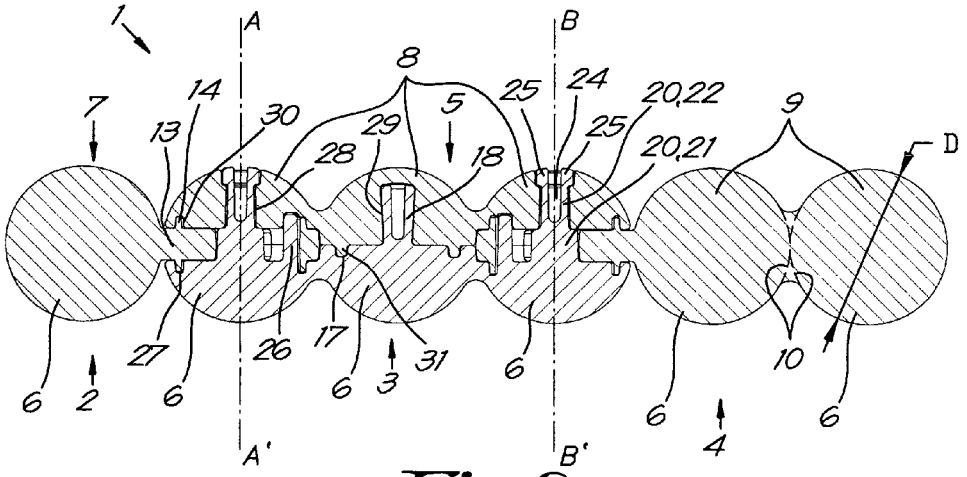
FIG. 2 shows a cross-sectional view according to line II-II of the game piece of FIG. 1.

The game piece 1 shown in FIGS. 1 and 2 consists of four parts 2,3,4,5. Together these parts 2,3,4,5 form six sphere-shaped elements 6, divided into three groups 7, 8, 9.

The elements 6 are, except for the regions where they are connected to other elements 6, spherically shaped, defining spheres 10 with diameter d.

The first group 7 consists of one element 6, the second group 8 consists of three elements 6 connected to each other in fixed positions, in this example but not necessarily in a straight line, and the third group 9 consists of two elements 6 connected to each other.

The first group 7 and the second group 8 are connected to each other in a way that they can make a rotating movement around an axis of rotation A-A'. The third group 9 and the second group 8 are also connected to each other in a way that they can make a rotating movement, this time around an axis of rotation B-B'. Both axes of rotation A-A' and B-B' go through the centre of an element 6.

The elements 6 are connected to each other at a centre-to-centre distance that equals the diameter D of the sphere 11. In other words, the imaginary spheres 10 defined by adjacent elements 6 touch, but do not intersect.

The movability of the groups 7, 8, 9 with respect to each other is obtained by the fact that the two elements 6 at the extremes of the second group 8 are executed as hinges.

Figure 3:
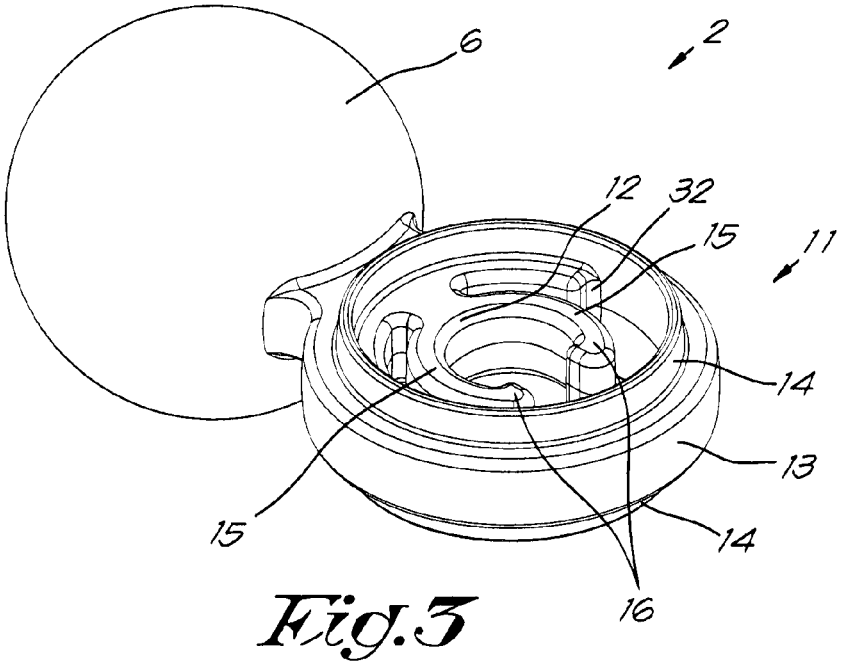
FIGS. 3 and 4 show one constituting part of the game piece of FIGS. 1 and 2.
Figure 4:
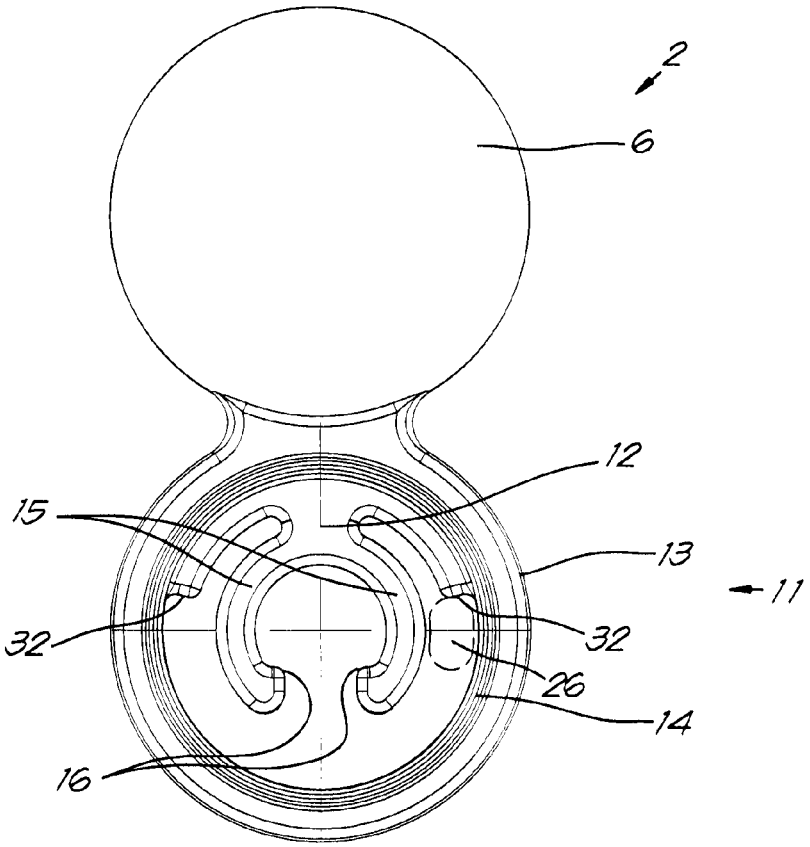
Figure 5:
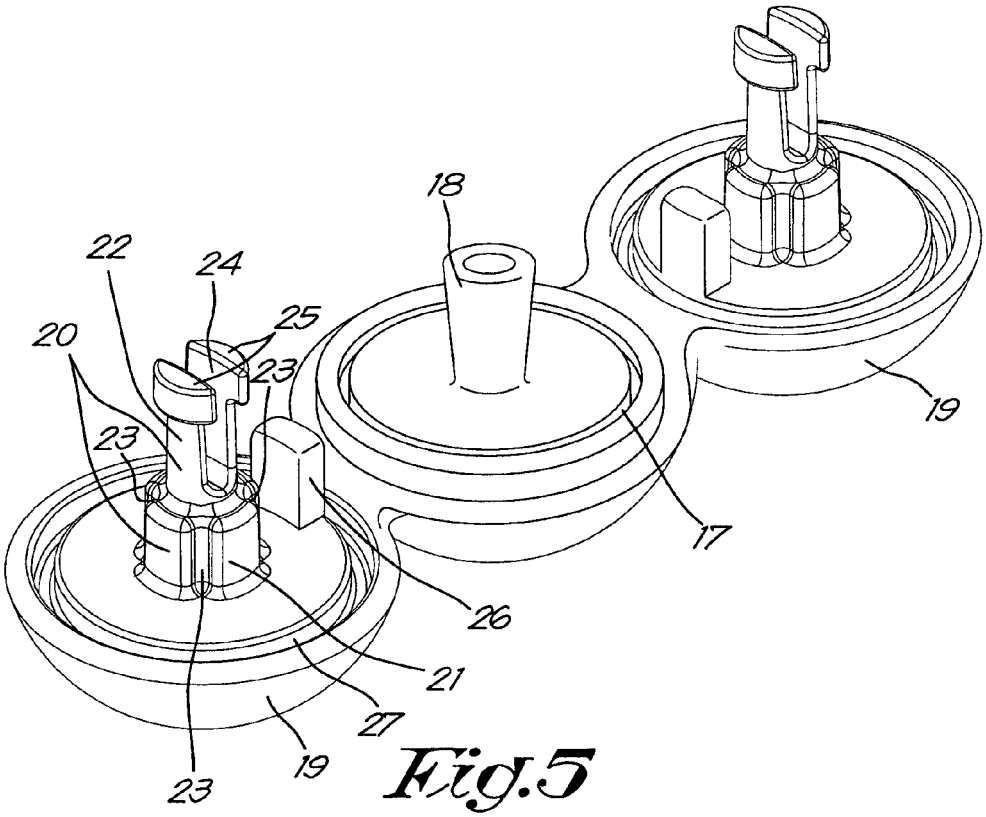
FIG. 5 shows another constituting part of the game piece of FIGS. 1 and 2.

The exact embodiment of the hinges is shown in FIGS. 3, 4 and 5.

FIGS. 3 and 4 show the first part 2 of the game piece 1. This consists of a sphere-shaped element 6 fixed to the female part 11 of a hinge.

This female part 11 is composed of a claw 12 inside and outer ring 13. On both sides the ring is provided with a circular ridge 14.

The claw 12 is formed by two arms 15, which are each provided with a protrusion 16 which is directed towards the centre of the ring 13.

FIG. 5 shows the second part 3. This consists of three approximately half-spherical elements fixed to each other in a straight line. The middle one of these half-spherical elements is provided with a circular groove 17 and a pin 18.

The two other half-spherical elements of the second part 3 are identical. Each forms the male part 19 of a hinge.

These male parts 19 of the hinge are formed by a hinging axis 20 formed from a first section 21 and a second section 22. The first section 21 is cylindrical with four elongated recesses 23 situated at, in this example, 90 degree intervals. The second section 23 is also cylindrical with a central slit 24 defining two legs 25.

The male parts 19 are also provided with a stop 26 and a circular groove 27.

The third part 4 of the game piece 1 is analogous to the first part 2, except that it has two elements 6 instead of one.

The fourth part 4 is a lid, not further elaborated in detail, shaped as three half-spheres and provided with holes to match pin 18 and legs 25, and shaped to be complementary to the groove 17 and ridge 14.

The game piece 1 is assembled by taking one each of first to fourth parts 2,3,4,5.

The claw 12 of the first part 2 is then put around one of the hinging axes 20 of the second part 3, more in particular around the first section 21 of it. This causes the first ridge 14 to sit in the groove 27.

The same action is done with the third part 4 using the other hinging axis 20 of the second part 3.

In a final step the fourth part 5 is put over the second part 3, whereby the legs 25 click into place in holes 28 provided in this fourth part 5 and extending through this fourth part 5, pin 19 engages a hole 29 in the fourth part 5 not extending through it, grooves 30, similar to grooves 27, cover ridges 14, and ridge 31 sits in groove 17.

The length of the hinging axes 20 is made such that they do not extend outside the spherical part of the elements 6.

The use of the game piece 1 according to the invention is as follows.

The groups 7, 8, 9 can be rotated with respect to each other around the hinging axes 20. When the protrusions 16 and the recesses 23 have a matching position the protrusions 16 place themselves into the recesses 23, locking the relative position of the groups 7, 8, 9.

This can be felt by the user of the game piece 1 due to an increased resistance against further movement. The locking can easily be overcome however by increasing the force, upon which the protrusions 16 will be pushed out of the recesses 23, which is possible due to a certain resilience of the arms 15, after which a further rotational movement is possible.

The recesses 23 and protrusions 16 are in this example placed in a position which will produce the locking action when the groups 7,8,9 are in a straight line or when they are at right angles.

Irrespective of the rotational positions of the groups 7,8,9 with respect to each other, the centres of the elements 6 are always in a single plane, and the axes of rotation A-A' and B-B' are always perpendicular to this plane.

When the groups 7,8,9 are rotated further, from a certain position onwards, the stop 26 prevents the groups 7,8,9 from being rotated further by being pushed against an edge 32, as shown in dotted lines in FIG. 4.

If a further force is applied the parts 2,3,4,5 may deform and become dislodged, damaging the game piece 1. This is counteracted by the combination of ridges 14 in grooves 27 and 30, which will keep the central axis of the male parts and the female parts of the hinges in line with each other, thereby avoiding damage to the game piece 1, obviously only until excessive force is applied.

The game pieces 1 as explained above may be used as a set, with a matching playing board having recesses for the elements, as pieces of a puzzle, wherein the filling of a certain two dimensional or three dimension space should be achieved.

The elements 6 and or the parts 2,3,4,5 may be provided with patterns or in different colours.

It will be clear to the skilled person that depending on the number of elements in each group, the numbers of groups in a game piece, the orientation of the elements within a group and the positioning of the connections between groups, an infinite variety of game pieces according to the invention can be made.

This is illustrated in FIG. 6 and further.

The game piece 1 shown in FIG. 6 and composed of five elements 6 allows a different type of rotational movement than explained above.

The game piece 1 shown in FIG. 7 is composed of 5 elements in two groups, of which one group, indicated by hatching, is not straight, but has its elements 6 fixed in an angled position.

The middle element 6 in this figure, even though indicated above to belong to the hatched group, may also be considered to belong to the non-hatched group, as its position with respect to the two non-hatched elements 6 is also fixed.

This middle element can therefore be considered to simulatenously form part of two groups.

FIG. 8 shows a straight game piece in two different configurations. In this figure, and also in later figures, a hinging axis is indicated by a solid dot.

This figure demonstrates that a game piece with exactly the same possible configurations, may be made from different constituent parts, in FIG. 8A with the female part of the hinge fixed to another element which is not an end element, and in FIG. 8B with the female part of the hinge fixed to an end element.

FIGS. 9 and 10 show a game piece 1 in a different configuration than the game pieces 1 explained in detail above.

The main differences are that the groups may be rotated with respect to each other with a click mechanism for positions corresponding to every 60° step, instead of every 90°, and that one group is connected to another group in the middle element of this other group, not an end element, so that a branched configuration is obtained.

The element forming the hinge can also in this example be considered to be in two groups at the same time.

FIG. 11 shows how the same configuration of game piece may be made from two different game pieces according to the invention, wherein these two different game pieces have different other preferred configurations.

FIG. 12 shows the range of possible configurations which is possible with a game piece with only five elements and two rotating axes.

The games pieces of FIGS. 11 and 12 also have preferential configurations at 60° intervals.

FIGS. 13 and 15 shows a game boards that may be used in conjunction with the game pieces. In the case of FIG. 13 with the game pieces of FIGS. 1 to 7, and in the case of FIG. 15 with the game piece of FIG. 9. The sizes and mutual distances and positions of the recesses in this game board should be made to match the size and mutual distance and positions of the elements of the game pieces.

FIG. 14 shows an alternative game piece in which within a single group a branched configuration is present, as opposed to FIG. 9, where this branched configuration is only present in the game piece as a whole.

The present invention is by no means limited to the embodiments described as an example and shown in the drawings, but a game piece according to the invention can be realised in all kinds of variants, without departing from the scope of the invention.

The invention claimed is:

1. Game piece (1) comprising three or more sphere-shaped elements (6) which are connected to each other, wherein the elements (6) are divided into two or more groups (7,8,9) each consisting of at least one element (6), wherein the elements (6) within one group (7,8,9) are immovably connected to each other and wherein each group (7,8,9) is rotationally connected to at least one other group (7,8,9), and wherein there is at least one group (7,8,9) with two or more elements (6);

whereby each group (7,8,9) is rotationally connected to another group (7,8,9) with an axis of rotation (A-A', B-B') coinciding with a line through the centre of an element (6), whereby all centres of the elements (6) lie in the same plane, and that the axis of rotation (A-A', B-B') for each combination of adjacent rotationally connected groups (7,8,9) is perpendicular to this plane, so that in all possible rotational configurations of the game piece (1) the centres of the elements (6) are in the same plane.

2. Game piece according to claim 1, characterised in that the sphere-shaped elements (6) are placed at a centre-to-centre distance from each other which is the same as the diameter (D) of the sphere (10) defined by the sphere-shaped elements (6).

3. Game piece (1) comprising three of more sphere-shaped elements (6) which are connected to each other, wherein the elements (6) are divided into two or more groups (7, 8, 9) each consisting of at least one element (6) wherein the elements (6) within one group (7, 8, 9) are immovably connected to each other and wherein each group (7, 8, 9) is rotationally connected to at least one other group (7,8,9), and wherein there is at least one group (7,8,9) with two or more elements (6); whereby each group (7, 8, 9) is rotationally connected to another group (7,8,9) with an axis of rotation (A-A', B-B') coinciding with a line through the centre of an element (6), whereby for each combination of adjacent rotationally connected groups (7,8,9) an element (6) of one of the two connected groups (7,8,9), which element (6) borders the other connected group (7,8,9), is formed as a spherically shaped hinge;

characterised in that the hinge is provided with indicating means (16, 23) to indicate that the two groups (7,8,9) connected by the hinge have a preferential rotational position as defined by the angle formed between the line between the centre of the element (6) which is formed as a hinge and the centre of the adjacent element (6) in the same group (7,8,9), and the line between the centre of the element (6) which is formed as a hinge and the centre of the adjacent element (6) in the other group (7,8,9).

4. Game piece according to claim 3, characterised in that the hinge has preferential positions at values of the angle of 90° and 180°.

5. Game piece according to claim 3, characterised in that the hinge has preferential positions at values of the angle of 60°, 120° or 180°.

6. Game piece according to claim 3, characterised in that the indicating means (16,23) work by providing a resistance to rotation which is larger when the two groups (7,8,9) are in a preferred position than when the two groups (7,8,9) are not in such a position.

7. Game piece according to claim 3, characterised in that the means comprise at least one protrusion (16) on one part of the hinge and at least one recess (23) in another part of the hinge.

8. Game piece (1) comprising three of more sphere-shaped elements (6) which are connected to each other, wherein the elements (6) are divided into two or more groups (7, 8, 9) each consisting of at least one element (6) wherein the elements (6) within one group (7, 8, 9) are immovably connected to each other and wherein each group (7, 8, 9) is rotationally connected to at least one other group (7,8,9), and wherein there is at least one group (7,8,9) with two or more elements (6); whereby each group (7, 8, 9) is rotationally connected to another group (7,8,9) with an axis of rotation (A-A', B-B') coinciding with a line through the centre of an element (6), whereby for each combination of adjacent rotationally connected groups (7,8,9) an element (6) of one of the two connected groups (7,8,9), which element (6) borders the other connected group (7,8,9), is formed as a spherically shaped hinge;

characterised in that the hinge is provided with a stop (26) to stop further rotational movement at a certain rotational position and is provided with means for avoiding damage if further force is applied if this position is reached, which means comprise a circular groove (27) in one part of the hinge and a matching circular ridge (14) on another part of the hinge, the groove (27) and the ridge (14) having a centre coinciding with the axis of rotation (A-A', B-B') of the hinge.

9. Set of game pieces (1) consisting of a number of game pieces (1) according to claim 1.

10. Game or puzzle, characterised in that it contains a set of game pieces (1) according to claim 9.

11. Game or puzzle according to claim 10, characterised in that it contains a playing board with a multitude of recesses matching the spherical elements (6) both in shape as well as in mutual distance.

12. Game piece according to claim 1, wherein each group is rotationally connected to at least one other group around a single axis of rotation only.

13. Game piece according to claim 12, characterised in that all centers of the elements (6) lie in the same plane, and that the axis of rotation (A-A', B-B') for each combination of adjacent rotationally connected groups (7,8,9) is perpendicular to this plane, so that in all possible rotational configurations of the game piece (1) the centers of the elements (6) are in the same plane.

14. Game piece according to claim 1, whereby the axis of rotation (A-A', B-B') for each combination of adjacent rotationally connected groups (7, 8, 9) is perpendicular to this plane in all possible rotational configurations of the game piece (1).

15. Game piece (1) comprising three of more sphere-shaped elements (6) which are connected to each other, wherein the elements (6) are divided into two or more groups (7, 8, 9) each consisting of at least one element (6) wherein the elements (6) within one group (7, 8, 9) are immovably connected to each other and wherein each group (7, 8, 9) is rotationally connected to at least one other group (7,8,9), and wherein there is at least one group (7,8,9) with two or more elements (6); whereby each group (7, 8, 9) is rotationally connected to another group (7,8,9) with an axis of rotation (A-A', B-B') coinciding with a line through the centre of an element (6), whereby for each combination of adjacent rotationally connected groups (7,8,9) an element (6) of one of the two connected groups (7,8,9), which element (6) borders the other connected group (7,8,9), is formed as a spherically shaped hinge;

whereby said hinge has a physical axis (20) at the position of the axis of rotation (A-A', B-B).

* * * * *